US006983112B2

(12) United States Patent
Asayama

(10) Patent No.: US 6,983,112 B2
(45) Date of Patent: Jan. 3, 2006

(54) ROTATION CONTROL AND HEATING CONTROL FOR A FIXING ROTATABLE MEMBER IN ROTATIONAL INDUCTION-HEATING TYPE APPARATUS

(75) Inventor: Atsushi Asayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/090,186

(22) Filed: Mar. 28, 2005

(65) Prior Publication Data

US 2005/0169654 A1 Aug. 4, 2005

Related U.S. Application Data

(62) Division of application No. 10/395,183, filed on Mar. 25, 2003, now Pat. No. 6,909,861.

(30) Foreign Application Priority Data

Mar. 25, 2002 (JP) ..... 2002-082194

(51) Int. Cl.
*G03G 15/20* (2006.01)

(52) U.S. Cl. ..... 399/67; 399/216; 399/469

(58) Field of Classification Search ..... 399/67, 399/70, 335, 336; 219/619, 469, 216
See application file for complete search history.

(56) References Cited

U.S. PATENT DOCUMENTS

| | | | | |
|---|---|---|---|---|
| 6,298,213 | B1 | 10/2001 | Miyamoto et al. | 399/320 |
| 6,349,187 | B2 * | 2/2002 | Hayashi | 399/70 |
| 6,909,861 | B2 * | 6/2005 | Asayama | 399/67 |

FOREIGN PATENT DOCUMENTS

| | | |
|---|---|---|
| JP | 1-289988 | 11/1989 |
| JP | 7-248695 | 9/1995 |
| JP | 11-338298 | 12/1999 |
| JP | 2000-155487 | 6/2000 |
| JP | 2002-334774 | 11/2002 |

* cited by examiner

*Primary Examiner*—Susan Lee
(74) *Attorney, Agent, or Firm*—Fitzpatrick, Cella, Harper & Scinto

(57) ABSTRACT

A fixing apparatus has a coil for forming a magnetic field; a fixing rotatable member for fixing an unfixed toner image carried on a recording material thereon by heat generated by eddy currents which is generated by the magnetic field; an electric power supply control for controlling electric power supply to the coil; and a rotating mechanism for rotating the fixing rotatable member. On the basis of a state of rotation of the fixing rotatable member a predetermined time after operation the rotating mechanism, the electric power supply to the coil thereafter is selectively carried out.

4 Claims, 9 Drawing Sheets

ROTATION CONTROL AND HEATING CONTROL FOR A FIXING ROTATABLE MEMBER IN ROTATIONAL INDUCTION-HEATING TYPE APPARATUS

This is a divisional application of U.S. patent application Ser. No. 10/395,183, filed on Mar. 25, 2003 now U.S. Pat. No. 6,909,861, allowed on Dec. 15, 2004.

FIELD OF THE INVENTION AND RELATED ART

An image forming apparatus of an electrophotographic type normally comprising a fixing device for an image forming apparatus of an electrophotographic type, wherein a transfer material and toner which is carried electrostatically on the transfer material and which comprises resin material, magnetic material, coloring material and the like are is passed through a nip formed by heating means (roller, endless belt member or the like) and pressing means (roller, endless belt member or the like) which are press-contacted with each other and rotated, wherein the toner is subjected to heat and pressure during the passage through the nip to fuse and fix the toner on the transfer material.

In a copying machine/printer or the like using an electrophotographic process, the toner electrostatically attracted on the recording material such as paper is fixed by heat and pressure. A fixing roller is press-contacted to a pressing roller to form a nip therebetween, through which a recording material carrying the unfixed toner image is passed. The toner is fixed on the recording material by the heat from the fixing roller and the pressure between the rollers. To the fixing roller, a temperature detection sensor is mounted to detect the temperature of the surface of the fixing roller, and the heat source is controlled to maintain the surface of the fixing roller at a predetermined level. There are various methods for heating the fixing roller in a copying machine, a printer or the like. The heat source is a halogen heater in one example, and is an induction heating type system in another example. In the heating roller type, the fixing roller is heated using radiant heat from the halogen lamp, and therefore, relatively long time is required to raise the temperature of the fixing roller to the predetermined temperature (start-up). If a large amount of electric power is supplied to the fixing roller in an attempt to quickly raise the temperature of the fixing roller, the electric energy consumption of the heat-fixing device increases against the demand for the energy saving. Therefore, it is desired that both of the energy saving in a heat-fixing device and quick start are accomplished. In the induction heating type system, eddy currents are generated in the fixing roller by a high frequency magnetic field generated by a high frequency current through a coil, and the joule heat is produced in the fixing roller per se due to the skin resistance of the fixing roller. According to the induction heating type, the high speed raising is accomplished since it does not use radiant heat as with the heat roller but use the heat directly generated in the fixing roller. In addition the electric energy consumption is possible. Therefore, use of the induction heating type system is proposed for the electrophotographic apparatus such as a copying machine, printer or the like. In the induction heating type system, in order to prevent non-uniformity in the temperature distribution in the fixing rotatable member, a high gap accuracy between the fixing rotatable member and the coil is desired. From this standpoint, the coil is desirably not disposed for all of the surface of the rotatable member, but is disposed for a part thereof. However, where it is partly disposed, the heat generation occurs only a part of the fixing rotatable member. In order to heat the entirety of the fixing rotatable member, it is required to rotate the fixing rotatable member. Thus, the coil is rotated during the raising operation in order to raise the temperature of the entirety of the fixing rotatable member such as a fixing roller, fixing belt or the like to a predetermined temperature. In one method, the electric power supply to the coil is started to start the heat generation after the rotation of the fixing rotatable member is stabilized. However, several seconds are required until a stabilized rotation of the fixing rotatable member is detected on the basis of locking signals from the motor for the fixing rotatable member. This results in relatively long time until the first copy is outputted with the sufficiently high temperature of the fixing rotatable member (FCOT; first copy time). It is preferable to generate heat before the rotation of the fixing rotatable member is stabilized in order to reduce the start-up time. If this is done, however, the heat generation for the fixing rotatable member continues even if the fixing rotatable member is not rotated or is rotated instably (abnormal situation) with the result of local excessive temperature rise of the fixing rotatable member. Then, there arises a problem that part or parts constituting fixing device including the fixing rotatable member, pressing rotatable member or the like are damaged. Particularly at the time of start-up, the difference between the temperature of the fixing rotatable member and the target temperature is large, the induction heating apparatus is often supplied with large electric power, with the result of remarkable excessive temperature rise. On the other hand, a method of detecting a temperature of the heat generating portion of the fixing rotatable member and preventing the excessive temperature rise, means that heat generation is stopped after occurrence of the excessive temperature rise, and therefore, does not prevent the excessive temperature rise.

SUMMARY OF THE INVENTION

Accordingly, it is a principal object of the present invention to prevent a local excessive temperature rise in a fixing rotatable member.

It is another object of the present invention to quickly start up a fixing rotatable member up to a predetermined temperature. It is a further object of the present invention to provide a fixing apparatus includes a coil for forming a magnetic field; a fixing rotatable member for fixing an unfixed toner image carried on a recording material thereon by heat generated by eddy currents which is generated by the magnetic field; electric power supply control means for controlling electric power supply to the coil; rotating means for rotating the fixing rotatable member; wherein on the basis of a state of rotation of the fixing rotatable member a predetermined time after operation the rotating means, the electric power supply to the coil thereafter is selectively carried out or not.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Figure 1:
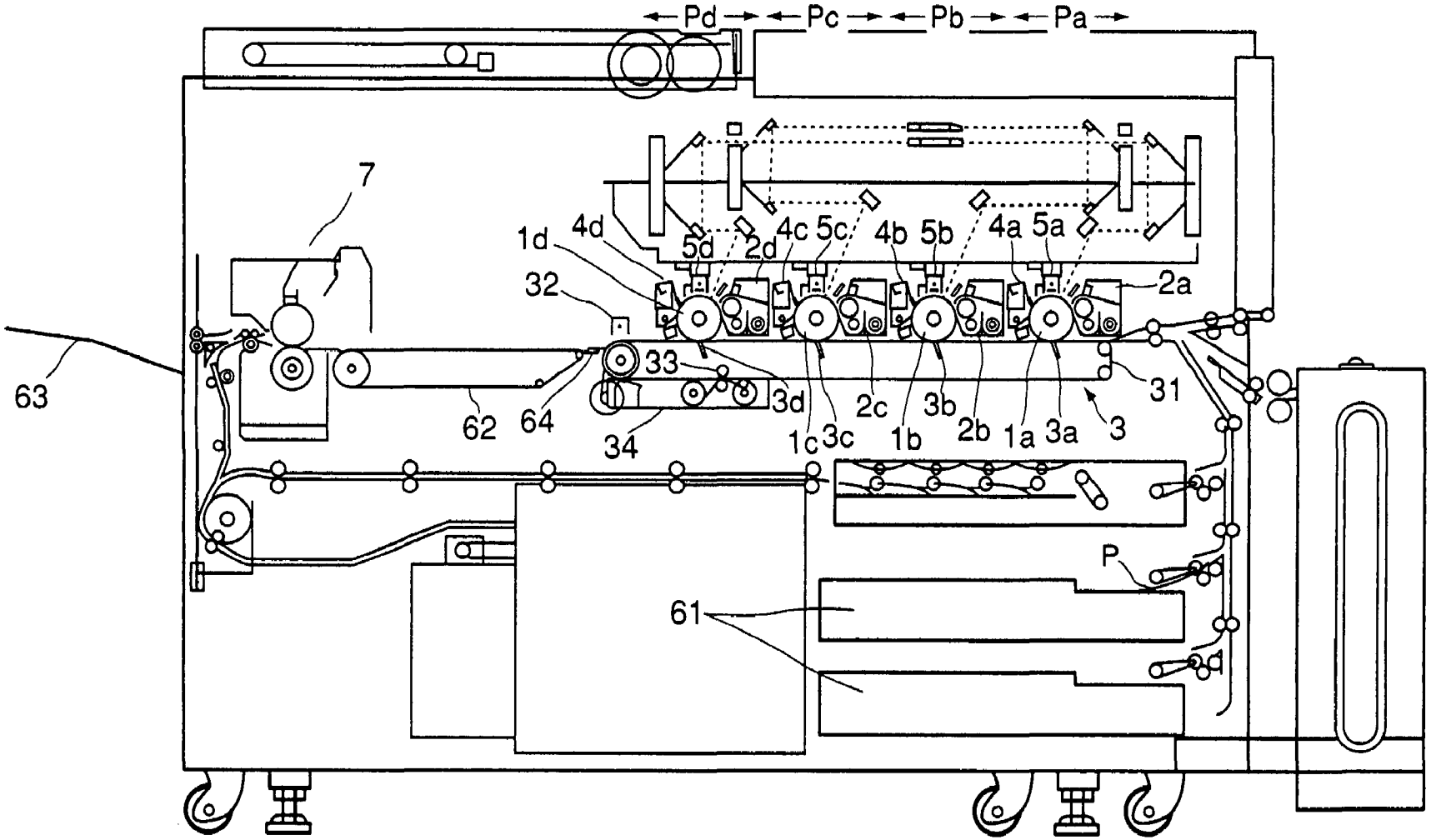
FIG. 1 is a sectional view of an image forming apparatus according to a first embodiment of the present invention.

Referring to FIG. 1, the description will be made as to a series of process operations for an image formation. FIG. 1 substantially shows a structure a four drum laser beam printer (printer) including a plurality of light scanning means, as an example of an image forming apparatus according to an embodiment of the present invention. As shown in FIG. 1, the printer of this embodiment comprises four image forming stations (image forming means) each including an electrophotographic photosensitive member as a latent image bearing member (photosensitive drum), and a charging device, developing device, cleaning device and the like around the electrophotographic photosensitive member. Images formed on the photosensitive drums formed in the respective image forming stations are transferred onto a recording material such as paper carried on feeding means passing by the latent image bearing member photosensitive drum. The image forming stations Pa, Pb, Pc, Pd functions to form images of magenta, cyan, yellow and black colors respectively and have the photosensitive drums 1*a*, 1*b*, 1*c*, 1*d*, and the photosensitive drums are rotatable in the direction indicated by an arrow. As regards the photosensitive drums 1*a*, 1*b*, 1*c*, 1*d*, there are provided chargers 5*a*, 5*b*, 5*c*, 5*d* for electrically charging the surfaces of the photosensitive drums, respectively; developing devices 2*a*, 2*b*, 2*c*, 2*d* for developing image information to which the photosensitive drums 1*a*, 1*b*, 1*c*, 1*d* are exposed after being charged by the chargers 5*a*, 5*b*, 5*c*, 5*d*, respectively; and cleaners 4*a*, 4*b*, 4*c*, 4*d* for removing the residual toner from the photosensitive drum after the images are transferred, respectively. They are disposed in the order named around each of the photosensitive drum 1*a*, 1*b*, 1*c*, 1*d* in the rotational direction. Below the photosensitive drum, there is provided a transfer portion 3 for transferring the toner images from the photosensitive drums onto the recording material. The transfer portion 3 includes a transfer belt 31 (recording material feeding means) which is common to the image forming stations, and chargers 3*a*, 3*b*, 3*c*, 3*d* for transfer charging operations, respectively. In such a printer, the paper P is supplied from the sheet feeding cassette 61 (recording material supplying means), as shown in FIG. 1, is passed through the respective image forming stations on the transfer belt 31, and received the color toner images from the respective photosensitive drum. By the transfer step, unfixed toner images are formed on the recording material. The recording material P carrying the unfixed toner images is separated from the transfer belt 31 and is transported by a conveyer belt 62 (recording material guiding means) to the fixing device 5. The description will be made as to the structures of the fixing device 7.

Figure 2:
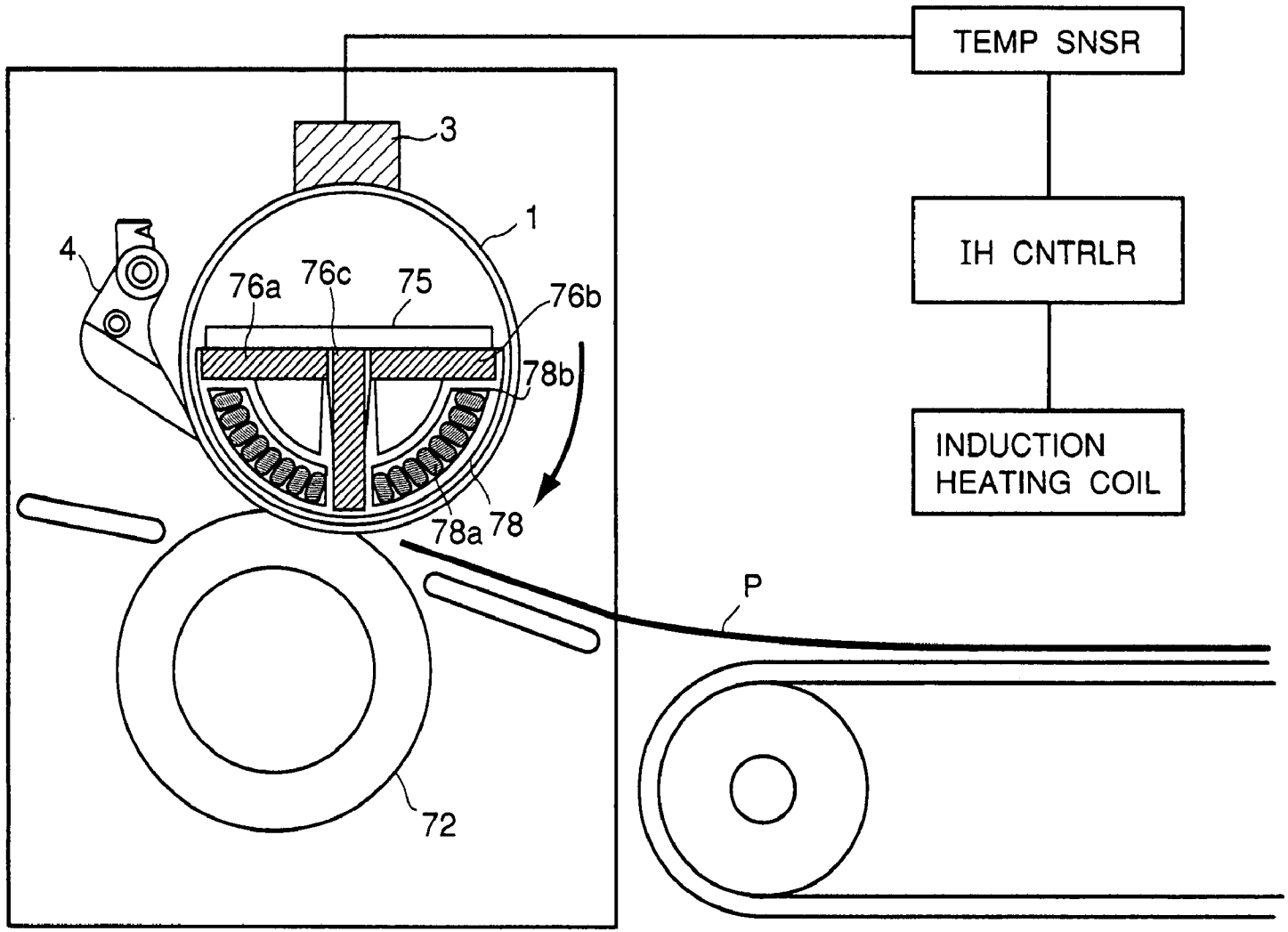
FIG. 2 is a sectional view of an induction heating type fixing device according to an embodiment of the present invention.

FIG. 2 is a sectional view of a fixing device according to an embodiment of the present invention.

The fixing roller 71 (rotatable member or fixing rotatable member) comprises a core metal cylinder of steel having an outer diameter of 32 mm and a thickness of 0.7 mm, and a parting layer of PTFE or PFA having a thickness of 10–50 μm which improves the surface parting property. As a material of the fixing roller, the use may be made with a magnetic material (magnetic metal) such as magnetic stainless steel that has a relatively high magnetic permeability and a proper resistivity. A non-magnetic material is usable if it is electroconductive (metal) and if it is thin enough. The pressing roller 72 (pressing member) has a core metal made of steel having an outer diameter of 20 mm, an elastic layer of silicone rubber having a thickness of 5 mm on the outer periphery of the core metal, and a parting layer of PTFE or PFA which improves the surface parting property having a thickness of 10–50 μm into an outer diameter of 30 mm, similarly to the fixing roller 71, The fixing roller 71 and the pressing roller 72 are rotatably supported, and the fixing roller 1 is driven to rotate by a motor (driving means). The rotation drive control will be described hereinafter. The pressing roller 72 is press-contacted to the surface of the fixing roller 71, and is driven by frictional force at the press-contact portion (nip). The pressing roller 72 is pressed by a mechanism by a spring in an axial direction of the fixing roller 71. The temperature sensor 73 (temperature sensor) is disposed so as to be contacted to the surface of the fixing roller 71, and compares the output of the temperature sensor 73 with the target temperature of the fixing roller 71 in the temperature detecting portion. In accordance with the result of comparison, the fixing roller 71 to the induction coil 78*a* (coil) is increased or decreased by an induction heating control circuit (electric power supply control means or IH control circuit), thus effecting an automatic control to provide a predetermined constant temperature at the surface of the fixing roller 71. The description will be made as to Detailed description will be made as to the induction heating coil unit 78 (coil unit). The induction coil 78*a* is supplied with a high frequency electric power of 100–2000 kW, and therefore, it is made of Litz comprising several fine wires. The litz wire is wound and is integrally molded with a resin material (non-magnetic member). The resin material may be PPS, PBT, PET, LCP (liquid crystal polymer) or the like resin material which is non-magnetic. Designated by 76*a*, 76*b* and 76*c* are magnetic cores which comprise high magnetic permeability and low loss material such as ferrite. When an alloy such as permalloy is used, a laminated structure may be used since otherwise the eddy current loss in the core is large when the frequency is high. The core is used to raise the efficiency of the magnetic circuit and to provide a magnetic blocking effect. The coil unit 78 is mounted to a stay 75 and is fixed relative to the fixing device. The description will be made as to the induction heating type.

Figure 3:
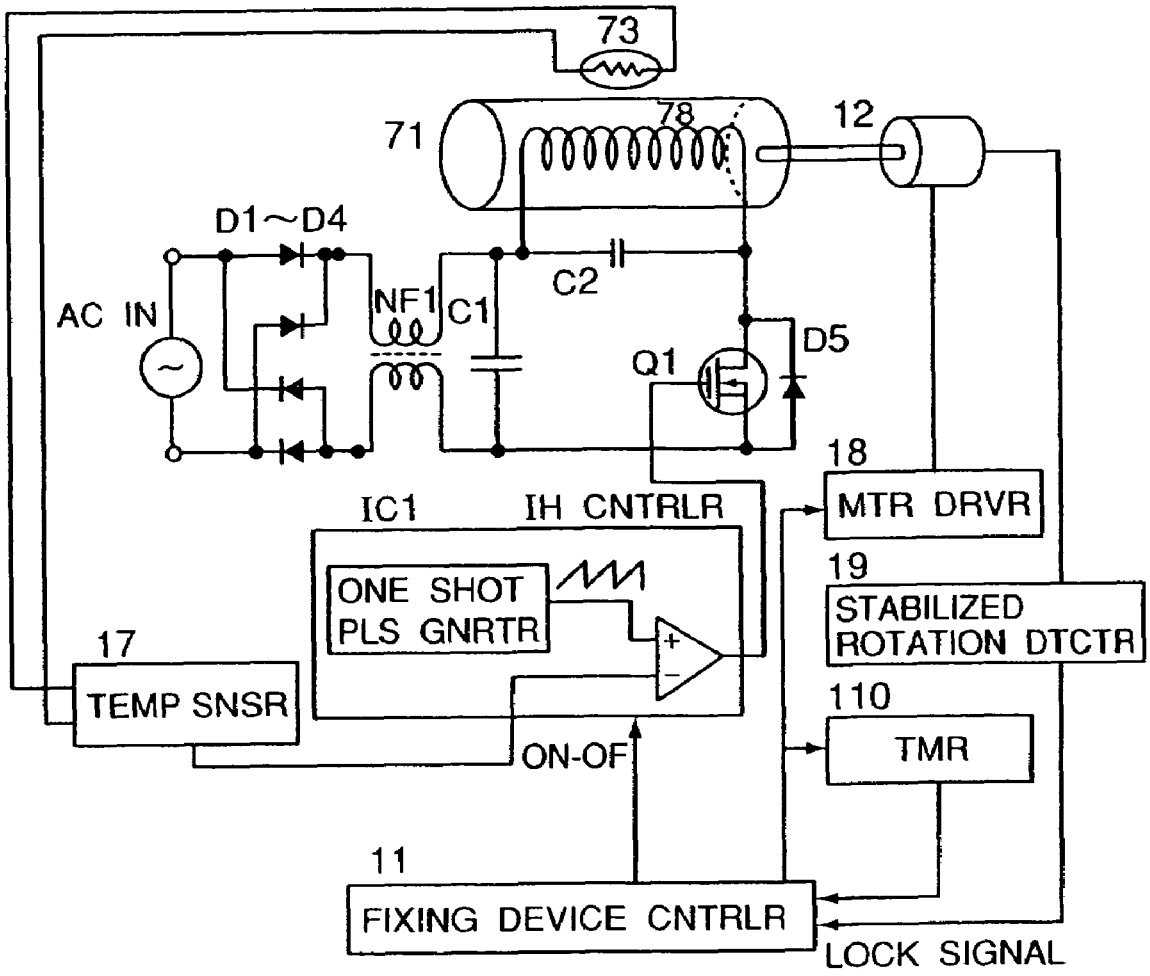
FIG. 3 is a schematic electric circuit according to the first embodiment of the present invention.
Figure 6:
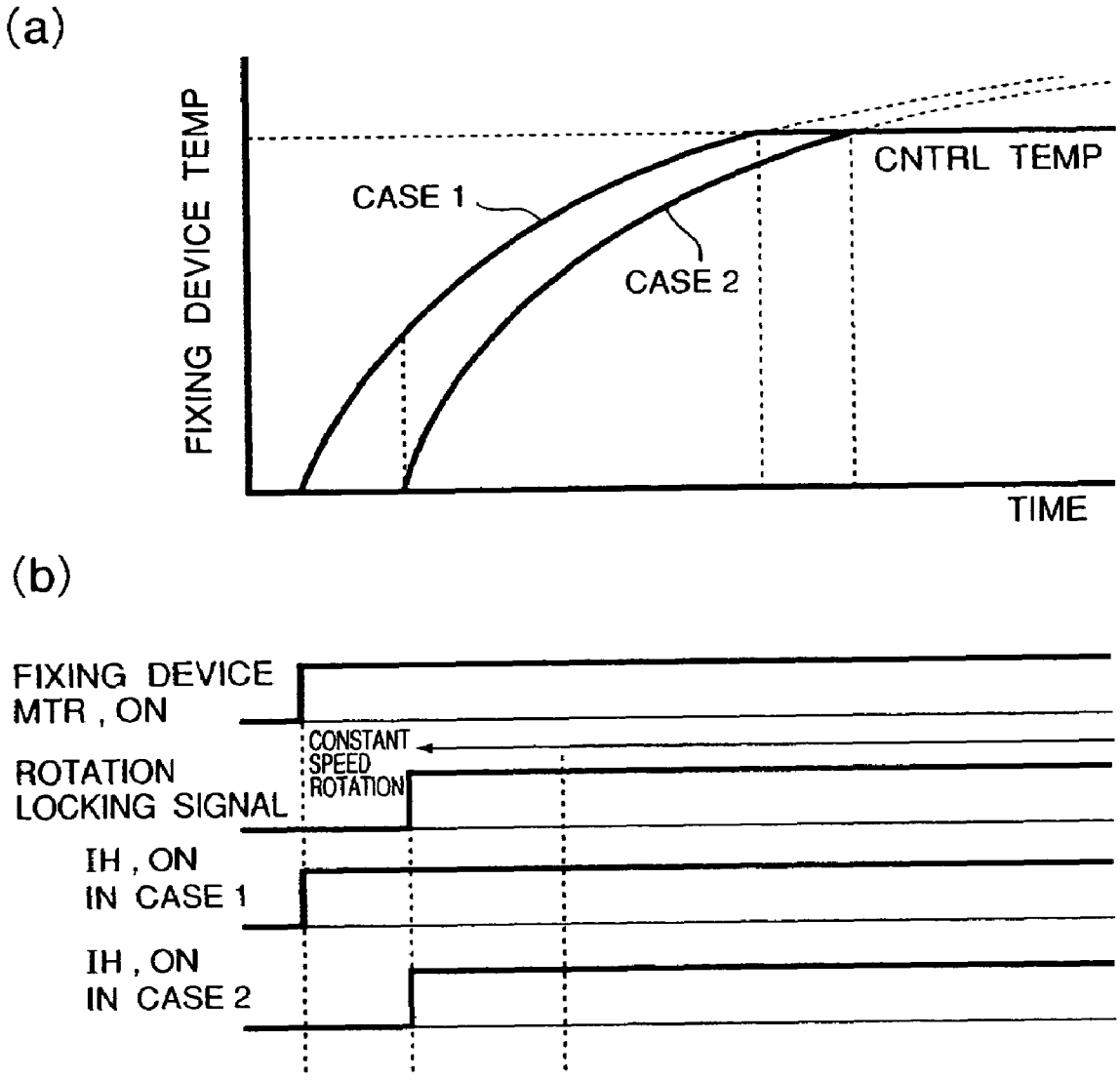
FIG. 6 shows (a) a relation between te fixing roller temperature and time, (b) a relation between the fixing roller temperature and time, both in normal operation.

FIG. 3 is a schematic illustration. In FIG. 3, designated by C2 is a resonance element of the induction coil 78*a*. Designated by D1 D1–D4, NF1, C1 constitutes a rectifying circuit for rectifying and converting the input AC electric power to a pulsating flow. The pulsating flow provided by the rectifying circuit is subjected to a high frequency switching by an electric power switch element Q1 including IGBT or the like to flow a high frequency current through the induction coil 78*a*. In this manner, by the high frequency current flowing through the induction coil 78*a*, induced current is induced in the fixing roller 71 which is made of a magnetic material, so that eddy currents are generated in the fixing roller 71. By the eddy current, joule heat is generated in the fixing roller 71. By this, fixing roller 71 per se generates heat. The electric power supply to the induction coil 78*a* is controlled by controlling the ON time of the Q1. The fixing device of the induction heating type is characterized by (1) the heat generating portion is the fixing rotatable member per se, (2) since the applied electric power is adjustable, a maximum tolerable electric power can be applied, and (3) since the temperature ripple can be reduced, the thickness of the fixing rotatable member can be reduced. Accordingly, the speed of the temperature rise of the fixing rotatable member can be higher than in the case of halogen heater. As a result, the first copy time which is the time required from the image formation start signal or copy start signal input after the raising to the actual output of the image, can be shortened. FIG. 6 deals with (case 1) where the electric power supply to the induction coil (induction heating) is started simultaneously with actuation of a fixing rotatable member motor for rotating (actuation of rotating operation signal (on)) and stooping (deactuation of rotating operation signal (off)) the fixing rotatable member, and (case 2) where the electric power supply to the induction coil (induction heating) is started after actuation of a fixing rotatable member motor for rotating (actuation of rotating operation signal (on)) and stooping (deactuation of rotating operation signal (off)) the fixing rotatable member and subsequent arrival at the constant speed rotation state of the fixing rotatable member.

(Case 1)

The time required for the temperature of the fixing rotatable member to reach the target temperature (target fixing temperature) can be minimized. However, if the fixing roller is not rotated due to a driving system malfunction, sheet jam or the like, the heat generation occurs and continues at the portion where the eddy currents are generated in the fixing rotatable member. Since the fixing rotatable member is not rotated, the heat quantity removed by the fixing rotatable member, the temperature locally becomes excessively high. As a result, the fixing roller is damaged by fusing or the like.

(Case 2)

The time required for the fixing device to reach the control temperature is longer than in case 1. However, if the fixing roller is not rotated due to a driving system malfunction, sheet jam or the like, it is discriminated that constant speed is not carried out, the induction coil is not supplied with power, and therefore, the fixing roller or the like is not damaged by fusing or the like. In consideration of the above, according to this embodiment, the electric power supply to the induction coil ((induction heating) is started at actuation of the fixing rotatable member motor, and then, the discrimination is made at a point of time a predetermined time after the actuation of the rotatable member motor as to whether or not the fixing rotatable member rotates at a constant speed by activation of a motor locking signal. In accordance with the state of rotation of the fixing rotatable member, it is discriminated whether the heating is to be continued or stopped. The motor locking signal is produced when the rotational frequency of the motor is within a predetermined range from the normal rotational frequency after the detected rotational frequency of the motor is compared with the predetermined rotational frequency. The signal is used for discrimination of the rotational state of the fixing rotatable member. When the locking signal is not produced, the rotational frequency of the motor is not as expected, and when the locking signal is continuously outputted, the motor is supposed to rotate stably. The description will be made as to the desirability of rotating the fixing roller when the current flows through the induction coil. The induction coil 78*a* (coil), as shown in FIG. 2, is disposed opposed to a part of the fixing roller (fixing rotatable member). Therefore, the portion of the fixing roller 71 where the heat is generated by the magnetic field formed by flow of the current in the induction coil 78*a*, is not the entirety of the fixing roller but is the part of the fixing roller 71. On the other hand, in one method, the induction coil is so disposed that entirety of the fixing roller 71 is heated by the flow of the current through the induction coil 78*a*. In that case, however, it is difficulty to make uniform the distance between the induction coil and the fixing roller in order to prevent the non-uniformity in the temperature. If there is a portion where the heat radiation condition is different, the temperature non-uniformity is unavoidable. Therefore, it is desired that entirety of the fixing roller 71 is heated during the start-up operation of the fixing device; and then, the fixing device is placed in a stand-by state; and upon production of the image formation signal, the temperature of the fixing roller at the nip is quickly raised to the target temperature in a small number of rotations. According to this embodiment, the entirety of the fixing roller is preheated by the rotation, in the structure in which the heat generating position for the fixing rotatable member is localized.

Referring to FIG. 3, there is shown a schematic electric circuit of the fixing device according to an embodiment of the present invention.

In this Figure, designated by 78*a* is an induction coil for inducing an induced current in a member to be heated which is made of a flat magnetic material, and a capacitor C2 is electrically connected in parallel with the induction coil 78*a*, wherein the capacitor C2 is a resonance element constituting a resonance circuit. A rectifying circuit is constituted by diodes D1–D4, a noise filter—NF1 and a capacitor C1 and is effective to rectify an AC electric power from a commercial voltage source into a pulsating current. The noise filter NF1 and the capacitor C1 constitute a noise filter circuit for reducing the electrical noise due to the high frequency current. To the switching circuit Q1 is connected to an integrated circuit IC1 which is an induction heating control circuit and which is effective to control the switching state. A diode D5 is connected in reverse parallel to rectify a flywheel current from the induction coil 78*a* produced upon deactuation of the switch Q1. The electric power conversion circuit functions to prevent opposite current from flowing due to a counterelectromotive force produced by the flow of current through the induction coil 78*a*. The thermister 73 (temperature sensor) is disposed contacted to the fixing roller 71 substantially at the central portion of the fixing roller 71. The thermister 73 and the temperature detecting portion 17 for detecting the output of the thermister 73 constitutes a temperature sensing circuit for detecting the temperature of the central portion of the fixing roller 71. A feed-back signal is fed to the induction heating control circuit (IH control circuit) such that value detected by the temperature sensing circuit is the target temperature of the fixing roller 71 to control the amount of electric power supply to the induction coil 78*a*. In this manner, the induction heating apparatus is provided. The structure of the induction heating apparatus is an example and is not limiting in the present invention. The induction heating apparatus heats the fixing roller 71, and the fixing roller 71 is rotated by the motor 12. To the motor 12, there is connected a motor actuating means 18 (rotational driving means) for driving the motor and a stable rotation detecting means 19 (rotation detecting means) for detecting the rotation of the fixing rotatable member. A timer 110 (measuring means) is triggered by the motor actuation signal (rotation signal), and counts the time period until the stabilized rotation is confirmed by the stable rotation detecting means. The stable rotation here means that rotation of the fixing roller 71 maintains a predetermined rotational speed or that number of rotations of the fixing roller 71 per unit time is a predetermined number. When the rotation of the fixing roller 71 is discriminated as being stable by the stable rotation detecting means, a locking signal is outputted. The fixing device control means 111 is capable of outputting the signal to the motor actuating means 18, the timer 110, IH control circuit or the like, and is capable of receiving a signal from the timer 110 and the stable rotation detecting means 19 or the like.

(Embodiment 1)

The operation will be described.

Figure 4:
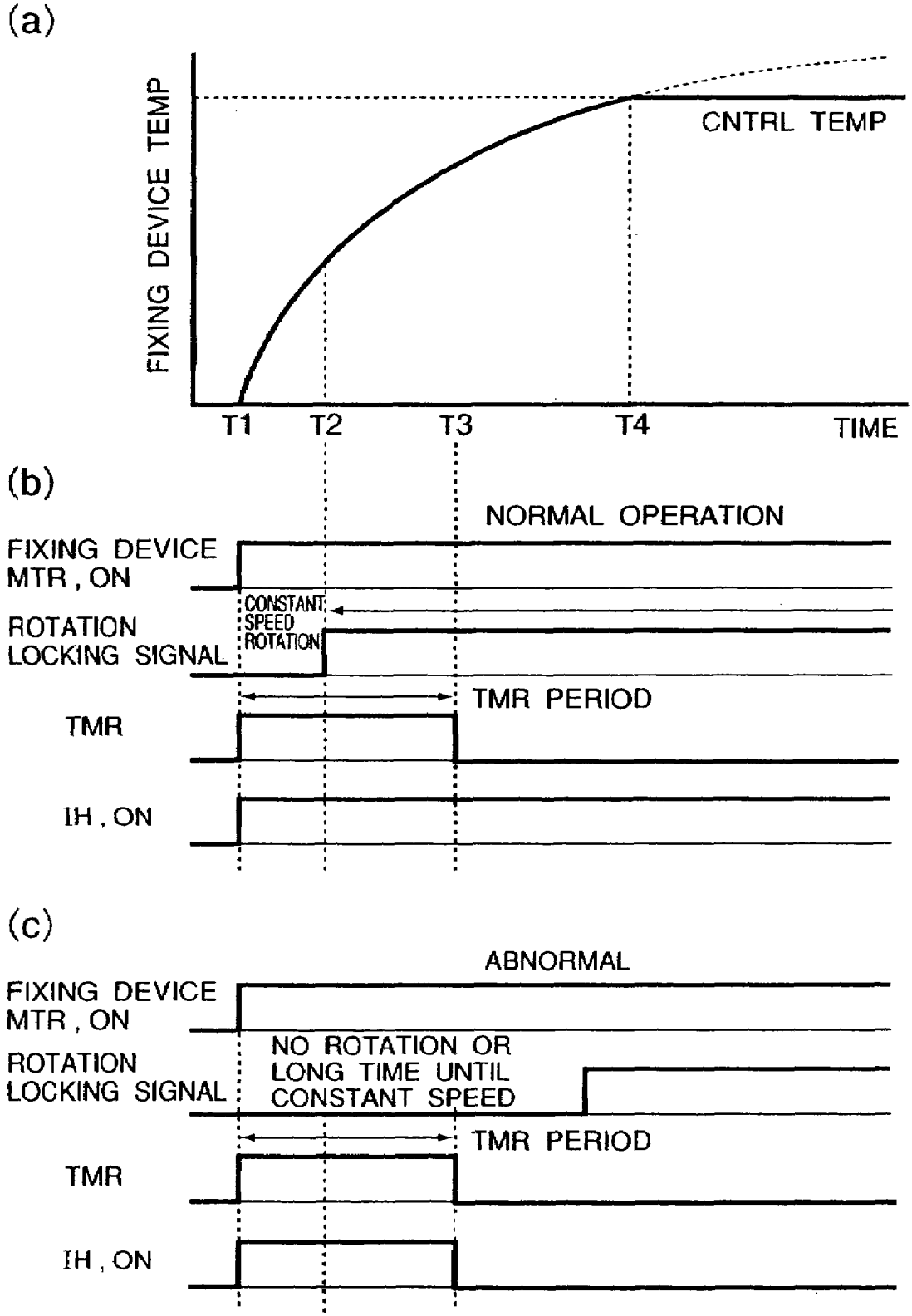
FIG. 4 shows (a) a relation between te fixing roller temperature and time, (b) a relation between the fixing roller temperature and time, both in normal operation, and (c) a sequence chart operated upon abnormal operation.

FIG. 4 deals with the case in which the fixing roller 71 is properly rotated (a), and the case in which the fixing roller 71 is not properly rotated (abnormality) (b). FIGS. 4(*a*) and (*b*) are flow charts for these cases.

(1) In FIG. 4, (*a*), a start signal for image formation is produced at time T1, and the image forming operation such as a printing, copying operation or the like is started. This is shown as step S01 in FIG. 5. The operation proceeds to step S02, and the fixing device control means 11 outputs a start signal to the motor actuating circuit means 18 to actuate the motor 12. And simultaneously, an ON signal is supplied to the IH control circuit. By the actuation of the IH control circuit, the operation proceeds to step S05 where the electric power is supplied to the induction coil 78*a* so that surface temperature of the fixing roller begins to rise. Upon production of the start signal, the operation goes to step S03, where the trigger signal is supplied to the timer 110 to start the timer 110. On the other hand, upon the start signal of the motor 12, the rotation detection for the roller is started and continues.

(2) The timer 110 having started in the step S03 counts up until the predetermined timer period ends. The timer period is approx. 1 sec–10 sec. This is because the fixing temperature rises at a rate of 30° C.–50° C. per sec with the structure of this embodiment. The value of the timer period is significantly influenced by the structure of the fixing rotatable member and the rotational speed of the fixing rotatable member, and is properly selected by one skilled in the art.

(3) If the fixing motor rotation locking signal is continuously inputted to the fixing control means 11 during the period of time T2 before T3 in FIG. 4(*a*), the normal rotation of the fixing roller 71 is discriminated a T3 in FIG. 4(*a*), so that electric power supply to the induction coil 78*a* continues after T3 in FIG. 4, (*a*). In this manner, it is discriminated whether to permit continuous electric power supply at step S06, when the rotation of the fixing roller 71 is normal, the operation proceeds to S08 to continue the electric power supply to the induction coil 78*a*. Thus, in the normal state, the electric power supply to the induction coil 78*a* continues, and the temperature of the fixing roller 71 reaches the target temperature (control temperature) at the point of time T4 in FIG. 4, (*a*). The electric power supply continues to the induction coil 78*a* such that target temperature is maintained until the rotation stops.

FIG. 4(*b*) case will be described.

(1) At time T1 in FIG. 4, (*b*), the start signal for the image formation is produced, in response to which the image forming operation such as a printing or copying operation or the like begins. The fixing device control means 11 produces to the motor actuating circuit means 18 a start signal so as to actuate the motor 12. Simultaneously, a trigger signal is supplied to the timer 110 to start the timer. By supplying ON signal to the IH control circuit, the electric power supply to the induction coil 78*a* is started, so that surface temperature of the fixing roller begins to rise.

Figure 5:
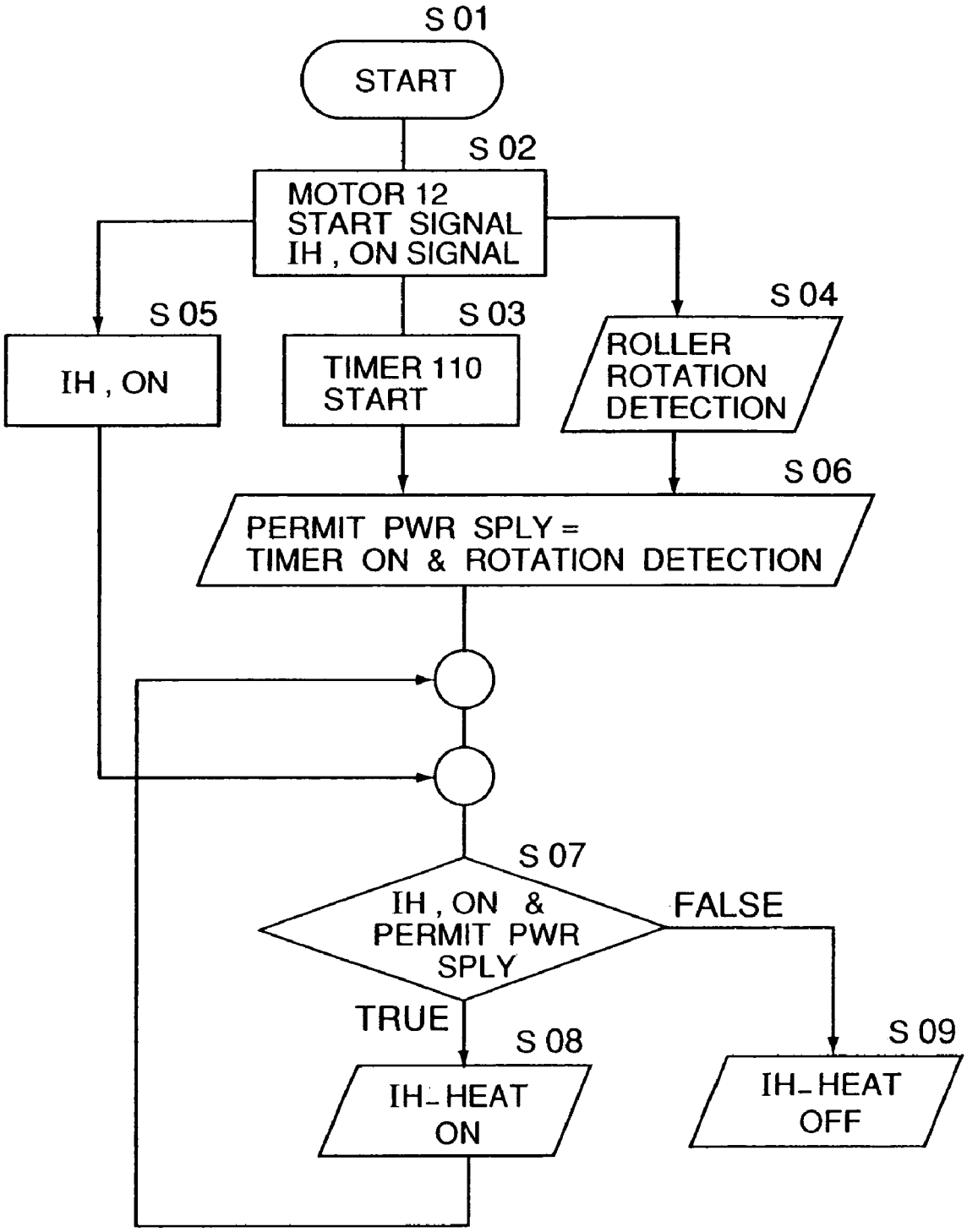
FIG. 5 is a flow chart of a system according to a first embodiment of the present invention.

(2) The timer 110 having started at T1 in FIG. 4, (*b*) counts up, and the timer period ends at T3 in FIG. 4(*b*). The flow of operations up to here in FIG. 5 are the same as the above-described steps S01–S06.

(3) If an abnormality arises before T3 in FIG. 4, (*b*) with the result of non-production of the fixing motor rotation locking signal to the IH control circuit, the electric power supply to the induction coil 78*a* stops at the point of time T3 in FIG. 4, (*b*) where the timer period ends. In FIG. 5, at step S07, an abnormality is discriminated, and the process proceeds to step S09, so that the electric power supply is stopped. After T3 elapses in FIG. 4, (*b*), the fixing roller 71 is at rest, and the electric power is not supplied to the induction coil 78*a*, and therefore, the local excessive temperature rise of the fixing roller 71 is prevented beforehand. Thus, according to the present invention, in the induction heating type, when the temperature of the fixing rotatable member is raised, the local excessive temperature rise due to the heat generation of the fixing rotatable member can be prevented beforehand even if the electric power supply to the coil is started before the fixing rotatable member rotates.

(Embodiment 2)

Figure 7:
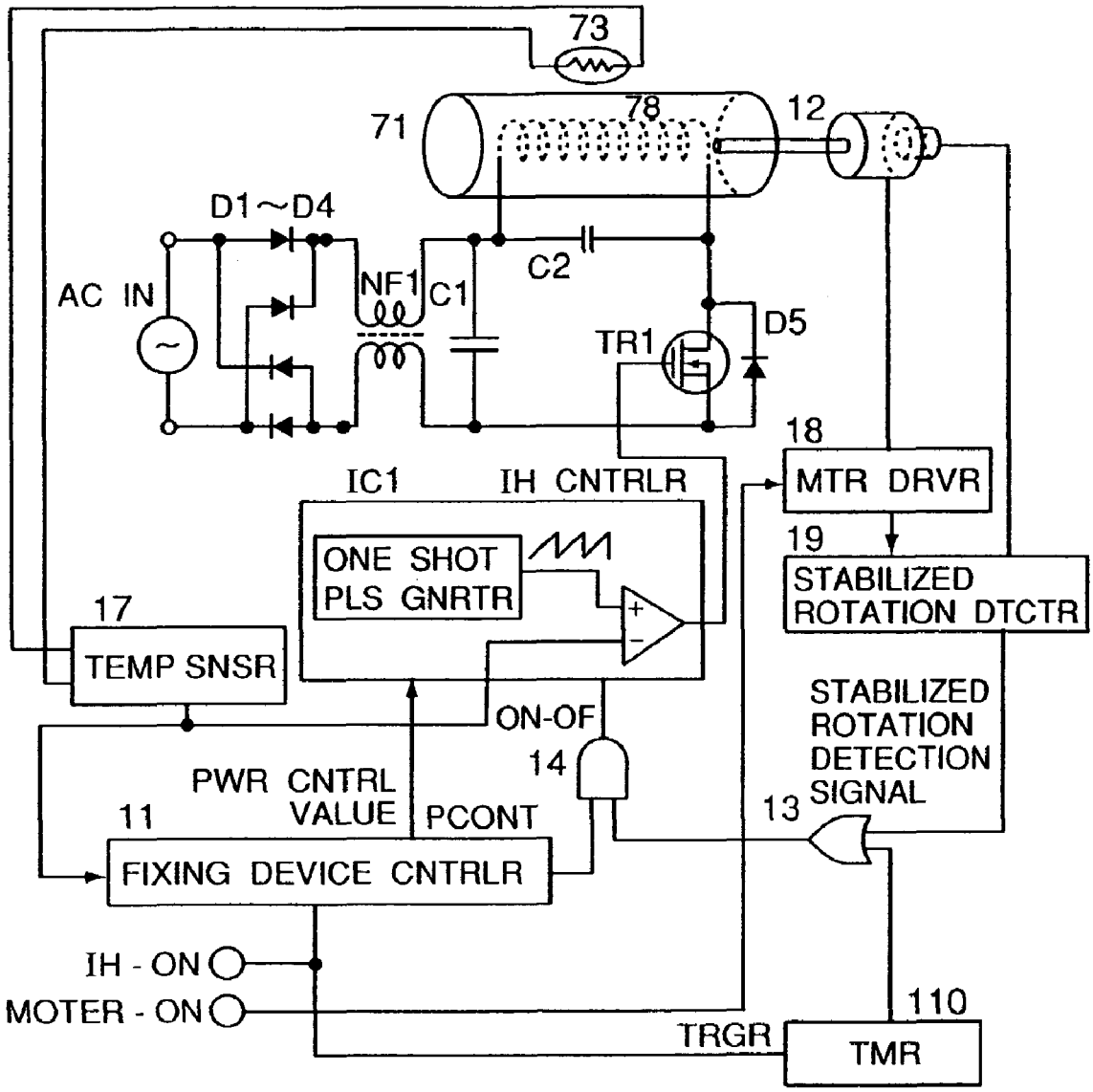
FIG. 7 schematically shows an electric circuit according to a second embodiment of the present invention.

Referring to FIG. 7, a further embodiment will be described.

When a motor start signal (Motor-ON) is produced, the motor is rotated through the motor actuating means. The state of rotation of the motor is monitored by the stable rotation detecting means. The description will be made as to an AND-gate 14 and an OR-gate 13 as an electronic element. First, as to the OR-gate 13, when the stable rotation detecting means outputs a signal indicative of normal state or when a timer count is inputted, the output is made from the OR-gate 13 to the AND-gate. When the electric power is supplied to the induction coil 78*a*, a signal is inputted from the fixing device control means to the AND-gate 14. When a signal is inputted from the OR-gate 13 to the AND-gate 14, that is, the signals are outputted to the AND-gate 14 from both, the electric power is supplied to the induction coil. On the other hand, only one signal is inputted to the AND-gate 14, no signal is outputted from the AND-gate 14 to the IH control circuit, and therefore, the electric power supply to the induction coil is not carried out. Thus, the abnormality in the rotation is detected by the stable rotation detecting means when the timer completes the count in the setting time period, no input is made to the OR-gate 13, and therefore, no input from the OR-gate 13 to the AND-gate 14. Therefore, the electric power supply to the induction coil does not continue. According to this embodiment, the discrimination as to whether to supply the electric power to the induction coil can be made in the electric circuit without processing of the central processing device (CPU), so that even when the CPU is out of order, the electric power supply to the induction coil can be instantaneously stopped. With elapse of the timer period, the electric power supply to the induction coil is discriminated in the electric circuit, so that excessive temperature rise can be assuredly prevented.

In Embodiment 1, the timer operation is started by actuation of the motor operation signal, but in this embodiment, the operation of the timer is started upon start (ON) of electric power supply to the coil.

Figure 8:
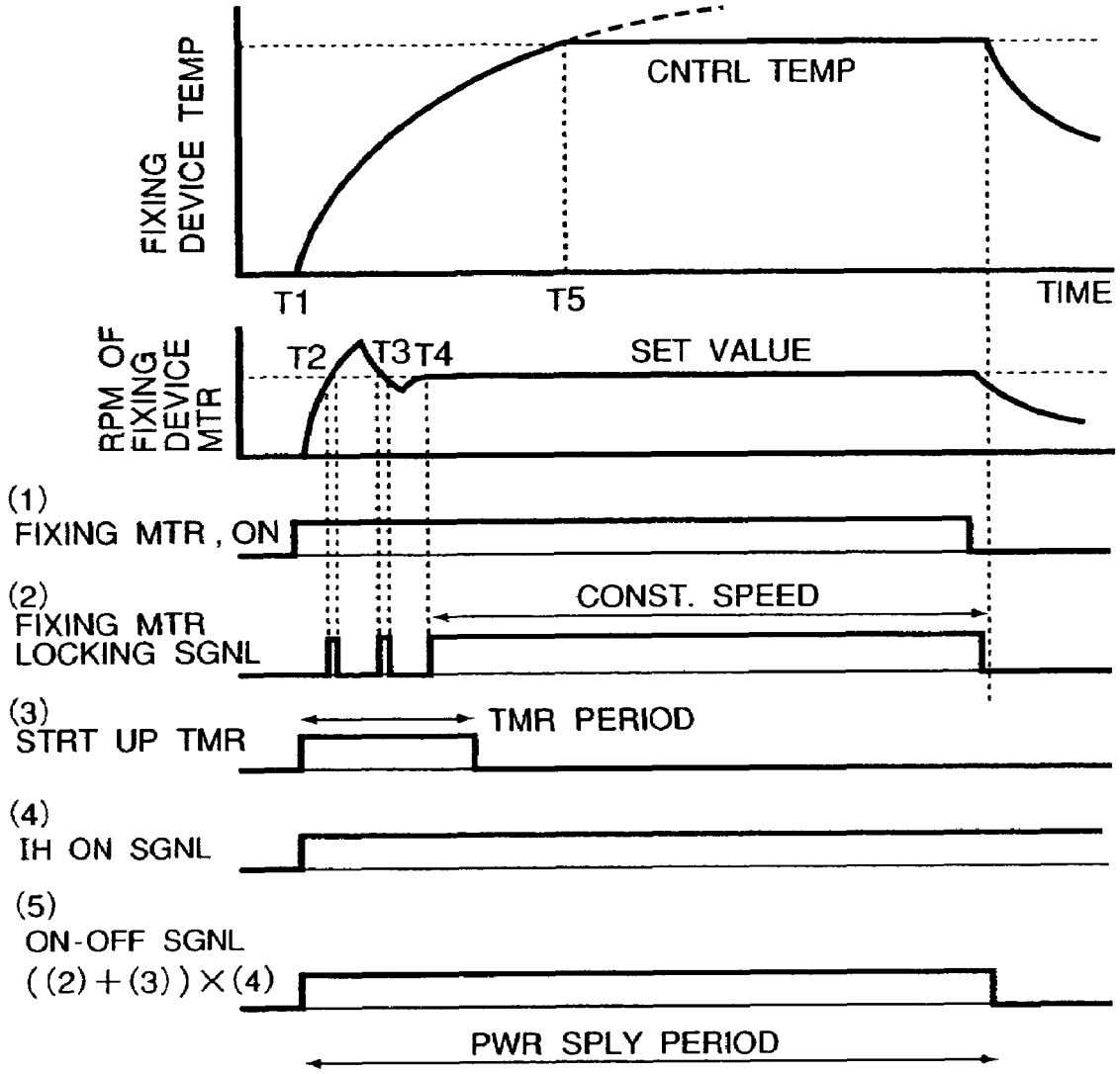
FIG. 8 illustrates an operation of the device according to the second embodiment.
Figure 9:
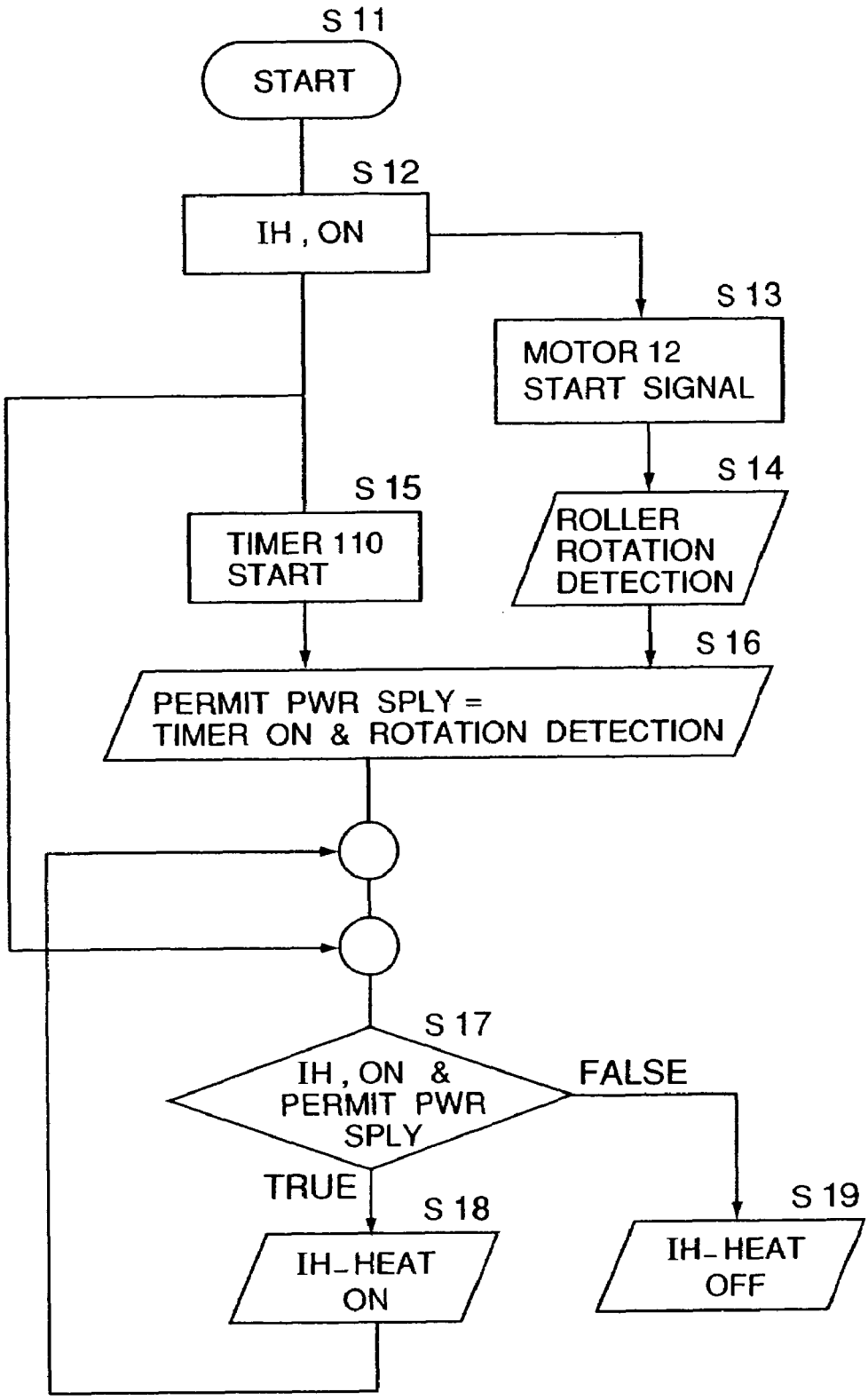
FIG. 9 is a flow chart of a system according to a second embodiment of the present invention.

Referring to FIGS. 8 and 9, the description will be made as to the operation.

(1) At time T1 in FIG. 8, a start signal for image formation is produced, in response to which an image forming operation such as printing or copying operation or the like is started. Then, an electric power supply start signal, namely, an IH-ON signal is outputted so as to start the electric power supply to the induction coil 78*a* from the IH control circuit. The fixing device control means 11 outputs a start signal to the motor actuating circuit means 18 so as to rotate the motor 12 (step S13 of FIG. 9). Thereafter, the detection of the motor 12 rotation is continued (S14 in FIG. 9). On the other hand, when the IH-ON signal is produced at step S12, the timer 110 operation starts (S15 in FIG. 9). In this embodiment, the operation of the timer 110 is triggered by the start signal of the electric power supply to the coil. By outputting the ON signal to the IH control circuit, the electric power supply to the induction coil 78*a* is started, and the surface temperature of the fixing roller begins to rise.

(2) The rotational frequency of the fixing motor in FIG. 8, the rotational frequency increases toward the set rotational frequency upon the start of the rotation, but when the rotational frequency reaches the set rotational frequency, it increases beyond the set rotational frequency (overshooting). At this time, the rotational frequency of the fixing rotatable member once becomes the set rotational frequency, in response to which the fixing motor locking signal is outputted. However, it goes out of the range of the set rotational frequency due to the overshooting, so that fixing lock signal becomes not produced again. Thereafter, the rotational frequency decreases to the set rotational frequency by the rotation control, and the fixing lock signal is again outputted. However, simultaneously with the set rotational frequency being reached, it is not possible to maintain the rotational frequency precisely, the rotational frequency becomes lower than the set rotational frequency, again. The rotational frequency of the fixing motor converges toward the set rotational frequency while repeating such operations. Thus, until the rotational frequency of the fixing motor is stabilized, such operations are repeated, and the short fixing lock signals are produced, but such outputs of the fixing lock signals are not discriminated as constant speed rotation of the fixing motor.

In this manner, at step S16 of FIG. 9, the discrimination is made as to whether or not the motor is properly rotated within the set period.

(3) When the motor is properly rotated, the continuance of the electric power supply is permitted at step S17 in FIG. 9, and the process goes to step S18 in FIG. 9, so that fixing motor continues a constant speed rotation after T4 in FIG. 8. On the other hand, if the rotational frequency of the fixing motor does not reach the constant speed rotational frequency within the timer period, an abnormality is discriminated at the step S17 in FIG. 9, and the operation proceeds to step S19 in FIG. 9. Then, the electric power supply to the coil is stopped after the end of the timer period.

As an alternative, both of the electric power supply start signal to the coil and the motor actuation start signal are used as triggers for starting the timer operation. This is another possible alternative.

According to this embodiment, in an induction heating type heating apparatus, even when the electric power supply to the coil is started before start of rotation of the rotatable member upon start up operation raising the temperature of the fixing rotatable member, the local excessive temperature rise due to the heat generation of the fixing rotatable member can be prevented beforehand. In addition, by actuating the timer simultaneously with the electric power supply start signal to the induction coil, the timer period can be as long as possible until immediately before occurrence of the excessive temperature rise. Therefore, even when a relatively long time is required until the rotation of the fixing motor is stabilized, the local excessive temperature rise can be prevented beforehand.

While the invention has been described with reference to the structures disclosed herein, it is not confined to the details set forth and this application is intended to cover such modifications or changes as may come within the purpose of the improvements or the scope of the following claims.

What is claimed is:

1. An image forming apparatus comprising:

image forming means for forming an image on a recording material;

rotatable heating means for heating the image formed on the recording material;

induction heating means for electromagnetic induction heating of said rotatable heating means; and electric power supply control means for controlling a supply of electric power to said induction heating means, wherein said electric power supply control means starts the supply of electric power to said induction heating means in response to an input to said image forming means of an image formation start signal, and, after the start of the electric power supply to said induction heating means, said electric power supply control means determines whether to continue the electric power supply to said induction heating means on the basis of whether the rotational speed of said rotatable heating means is whithin a predetermined range, and wherein, after a predetermined time elapses, the electric power supply is stopped when the rotational speed of the rotatable heating means is out of a predetermined range.

2. An apparatus according to claim 1, wherein said rotatable heating means generates heat partially with respect to a rotational direction by said induction heating means.

3. An apparatus according to claim 1, wherein electric power supply to said induction heating means is started before a start of rotation of said rotatable heating means.

4. An apparatus according to claim 1, wherein electric power supply to said induction heating means starts before the rotational speed of said rotatable heating means reaches a predetermined rotational speed.

* * * * *

UNITED STATES PATENT AND TRADEMARK OFFICE

CERTIFICATE OF CORRECTION

PATENT NO. : 6,983,112 B2
APPLICATION NO. : 09/808991
DATED : January 3, 2006
INVENTOR(S) : Atsushi Asayama It is certified that error appears in the above-identified patent and that said Letters Patent is hereby corrected as shown below:

SHEET NO. 7 of 9:
Figure 7, "MOTER" should read --MOTOR--.

COLUMN 1:
Line 16, "is" should read --are--.
Line 17, "comprises" should read --comprise--.
Line 19, "is" should be deleted.

COLUMN 2:
Line 1, "occurs" should read --occurs in--.

COLUMN 3:
Line 9, "te" should read --the--.

COLUMN 6:
Line 15, "difficulty" should read --difficult--.

Signed and Sealed this

Twenty-ninth Day of August, 2006

JON W. DUDAS
*Director of the United States Patent and Trademark Office*